US005267359A

United States Patent [19]

Clark

[11] Patent Number: 5,267,359

[45] Date of Patent: Dec. 7, 1993

[54] WATER TURBULENCE GENERATION IN SPAS

[75] Inventor: Wilsey J. Clark, Sun City, Calif.

[73] Assignee: Clark Manufacturing, Inc., Chino, Calif.

[21] Appl. No.: 970,598

[22] Filed: Oct. 28, 1992

Related U.S. Application Data

[63] Continuation of Ser. No. 832,449, Feb. 24, 1986, abandoned.

[51] Int. Cl.[5] ..... E04H 4/12; A61H 33/06

[52] U.S. Cl. ..... 4/509; 4/541.3; 4/541.5

[58] Field of Search ..... 4/490, 508, 512, 541.4, 4/541.5, 681, 507, 509, 541.3; 137/142, 215, 251.1, 247.41, 247.49; 210/121, 129, 169, 242.1; 261/121.1

[56] References Cited

U.S. PATENT DOCUMENTS

| | | | |
|---|---|---|---|
| 6,665 | 9/1875 | Butler | 137/247.49 |
| 446,345 | 2/1891 | Griffin . | |
| 1,450,956 | 4/1923 | Gottsch | 137/247.49 |
| 2,414,375 | 1/1947 | Hagen | 137/247.49 X |
| 2,856,611 | 10/1958 | Velonis | 4/543 |
| 3,080,154 | 3/1963 | Tanner | 261/121.1 |
| 3,212,268 | 10/1965 | Ortega | 210/169 X |
| 3,252,576 | 5/1966 | Miller | 210/169 X |
| 3,306,448 | 2/1967 | Baker | 4/512 X |
| 3,677,408 | 7/1972 | Dinizo, Jr. | 210/169 |
| 3,939,505 | 2/1976 | Gross | 4/512 |
| 4,000,528 | 1/1977 | Posnick | 4/541.5 X |
| 4,166,296 | 9/1979 | Darrah et al. | 4/543 |
| 4,170,044 | 10/1979 | Steimle | 4/488 |
| 4,218,784 | 8/1980 | Richards | 4/541.5 |
| 4,237,562 | 12/1980 | DuPont | 4/543 |
| 4,249,522 | 2/1981 | Carrier | 4/543 X |
| 4,467,645 | 8/1984 | Murphree | 73/215 |
| 4,512,042 | 4/1985 | Striegel | 4/492 |
| 4,608,167 | 8/1986 | Raubenheimer | 210/242.1 |
| 4,672,692 | 6/1987 | Savage | 4/541.5 |

FOREIGN PATENT DOCUMENTS

| | | | |
|---|---|---|---|
| 2161072 | 1/1986 | United Kingdom | 4/492 |

*Primary Examiner*—Henry J. Recla
*Assistant Examiner*—Robert M. Fetsuga
*Attorney, Agent, or Firm*—Lyon & Lyon

[57] ABSTRACT

A system is disclosed for generating turbulence in the water of a spa by a combination of water circulation and air bubble formation which system includes, in preferred form, a valveless trap for protection of the air blower in combination with an air flow distribution manifold having specially placed outlet ports and a floating weir in the water return circuit.

20 Claims, 1 Drawing Sheet

WATER TURBULENCE GENERATION IN SPAS

This application is a continuation of application Ser. No. 07/832,449 filed Feb. 24, 1986, now abandoned.

TECHNICAL FIELD

This invention relates to the generation of turbulence in the water of a spa by water circulation and the creation of air bubbles. It relates in particular to improvements in water and air flow circuitry elements.

BACKGROUND ART

Early spas were therapeutic facilities. They comprised pools whose water was heated and made to circulate and most were available on some basis to the public. With the availability of suitable plastic materials and small reliable water heaters, relatively low cost private spas were made possible. The first private spas included a simple means for circulating the spa water. Later, the circulation system was modified to return water to the spa in jet outlets placed where spa users could position themselves in the path of the water stream issuing from those outlets. In a further innovation, air was entrained into the returning water stream to increase water turbulence.

While the entrainment of air was successful as an improvement, an arrangement that provides even further enhancement is to have a bubble forming system separate from the water return system. That permits introduction of air at other than the water outlets and it permits inclusion of a number of air outlets greater than the number of water outlets. The systems having been thus separated, the air does more than enhance turbulence. The bubbles of air add to the kinds of sensations a spa user may experience. However, adding a separate air system adds substantially to the cost of the system and to its complexity.

BRIEF DISCLOSURE OF THE INVENTION

It is an object of the invention to provide an improved system for generating turbulence in spas.

A further object is to provide efficient, safe, reliable systems for circulating spa water and generating air bubbles in the water. A related object is to achieve those qualities at minimum manufacturing and maintenance costs.

Particular objects are to provide an improved weir for the water circulation system and improved water trap and manifold arrangements for the air flow system.

These and other objects and advantages of the invention which will be apparent upon examination of the accompanying drawing and a reading of the following specification, are realized by the provision of one or more, and preferably all three of a novel valveless water trap in the air system, a novel manifold in the air system and a novel floating weir in the water circulation system.

DESCRIPTION OF THE PREFERRED EMBODIMENT

Figure 1:
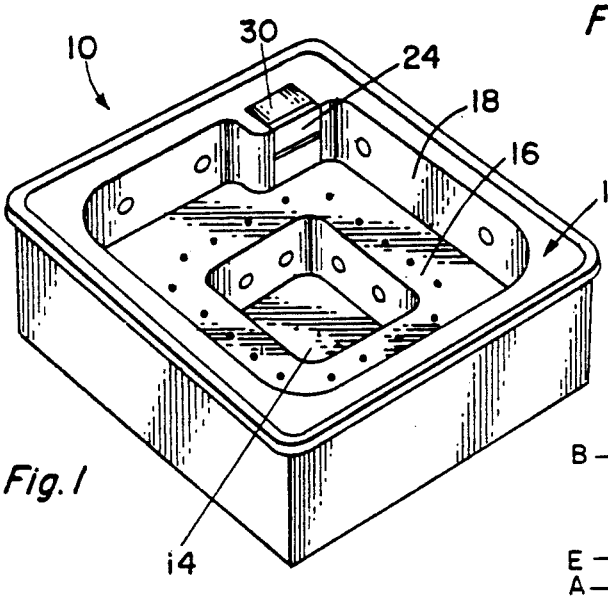
FIG. 1 is an isometric view of a spa in which the several features of the invention are embodied in preferred form.

The invention is applicable to spas in general. Because one of its major objectives is to permit the provision of a highly functional unit at a cost within the reach of home owners, a portable, private spa has been selected for illustration in the accompanying drawing where it is designated by the numeral 10. The interior shape of such spas varies substantially but most, like the spa 10, have a bench seat which extends around a foot well and which is itself surrounded by an encompassing wall. That interior portion is formed as a plastic shell. Typically it is formed of fiber glass and epoxy resin with a coating of acrylic or other resin on the inner wall. The shell is mounted in an enclosing structure which also houses the water circulation system, the bubble forming air system and apparatus for controlling the operation of those systems. The unit is portable and requires only electrical service if the water heater is electrically operated or electrical and gas service in the event the heater uses gas fuel.

In this case the shell 12 of the spa is formed with a foot well 14, a bench seat 16 and encompassing side walls 18. The shell is housed and supported in a enclosing structure 20. Circulating water enters the shell at outlet openings several of which are visible and one of which is numbered 22. Water leaves the shell at a weir which is fixed in the wall 18 and is generally designated 24. Air enters the shell at openings in the bench seat. One air opening is numbered 26.

Figure 2:
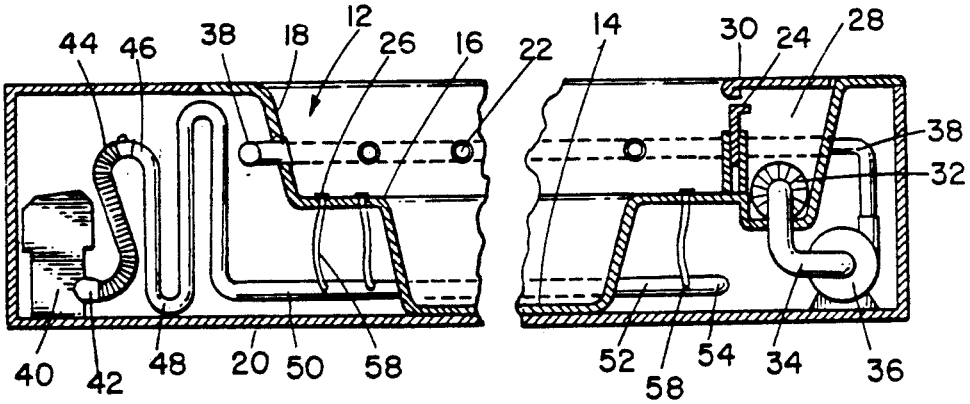
FIG. 2 is a schematic representation of the spa of FIG. 1.

Those portions of the spa which are related to the invention, or facilitate understanding of the invention, are shown in FIG. 2. Other elements including the water heater and the electrical control system are not essential to understanding of the invention. They are conventional and have been omitted for the sake of clarity. In FIG. 2, the spa shell 12 is disposed within the enclosure 20. The weir controls the flow of return water to a sump cavity 28 behind the weir. The sump cavity is covered by a lid 30 and it contains a filter unit 32 whose outlet is connected by a flow line 34 to a circulating pump 36. The outlet of the pump is discharged to a flow line 38 by which the water is conducted to the several jet outlet openings including outlet 22. The novel element in that circuit is the weir 24. The remaining elements, and the heater, are standard.

The air circuit includes a blower which forces ambient air through a water trap into an air flow line by which the air is conducted to the several air outlets. The escaping air forms bubbles which rise through the water made turbulent by the streams of water emerging from the water outlets and contribute to that turbulance. Because the air outlets are below the waterline, water is free to flow into the air flow line. For practical and aesthetic reasons the pump is located within the enclosure 20 with its outlet below the waterline in the spa. But for the trap, water would flow from the air flow line into the blower when the blower was not operating and even when operating. The prior art practice was to prevent back flow of water to the blower by installing a check valve in the flow line. Before air can flow through the line, the water it contains must be forced by the air from the line. Past practice has been to mold the shell with an integrally formed air flow path and to form the air openings by drilling through the inner shell wall into the flow path. To form the pathway in that fashion is expensive. The rational for that structural arrangement was that it would insure that if all the water was not forced from the air flowpath what remained would be disposed at the lower side of that path and air would reach all of the air openings.

Figure 3:
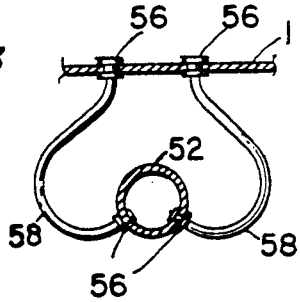
FIG. 3 is a cross sectional view of the air manifold of the spa of FIGS. 1 and 2.

It has been discovered that a much less expensive structural arrangement is possible with no loss of functionality. The preferred form is a tubular conduit configured as a manifold with a separate outlet port for each air outlet of the shell. Each manifold port and each air outlet is fitted with a tubular connector and a separate flow tube is connected to afford communication from each manifold port connector and its respectively associated air outlet connector. All that is required is that the manifold ports, at least those toward the end of the air flow line away from the blower, be formed in the lower portion of the manifold tube. "Lower portion of the tube" is defined to mean at a position such that the majority of any water at points along the length of the tube in the region of the ports would flow from the port by the action of gravity in the absence of air or water pressure. The ports being thus arranged, blower air is assisted by gravity in the manifold in driving water from the manifold. That feature is best implemented by mounting the manifold tube in a generally horizontal plane below the bench seat, or other portion of the shell from which the air openings are located. The manifold ports are formed at the longitudinal midplane of the manifold or below as shown in FIGS. 2 and 3. The volumetric rate of air supplied by the blower must be adequate to force water from the manifold, of course. The volume required in a given installation in which the invention is incorporated is no greater than what was required in the prior art.

In FIG. 2 the blower is numbered 40. Its outlet 42 is connected by flexible conduit 44 to one end of 46 of the water trap 48. The other end of the trap is is connected to the inlet end 50 of a pipe 52 of circular cross section whose other end 54 is sealed closed. The pipe 52 is perforated by ports at points along its length whereby it serves as a manifold. As best shown in FIG. 3, tubular fittings 56 of any suitable kind are fixed in the ports of the manifold and in the air outlets of the shell 12. A length of flexible flow tubing 58 interconnects each fitting of the manifold and shell with a respectively associated fitting of the shell and manifold to afford communication from the manifold to the interior of the shell. As best shown in FIG. 3, the ports of the manifold are formed below the horizontal midplane of the manifold. The preferred embodiment includes formation of the ports at any level at or below the midplane.

The trap 48 is formed by a tube arranged to have three vertically disposed legs, the first and second being interconnected at their upper ends and the second and third being interconnected at their lower ends. The vertical component of the length of the third leg from the high point of its connection to the second leg must be greater than the distance from the lowest point of the interconnection between the second and first legs to the highest point which the spa water can reach. Its operation is explained in connection with FIG. 4.

Figure 4:
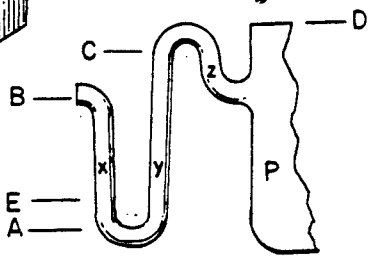
FIG. 4 is a diagram which illustrates the manner of operation of the water trap.

In FIG. 4, as in FIG. 2, the trap comprises a continuous tube formed by three legs having vertical portions X, Y and Z. The body of spa water is represented by P. Level A is the upper level of the connection between legs X and Y. Level B is the lowest level at which water could spill from the trap to the blower. Level C is the lowest level of the connection between legs Z and Y of the trap. Level D is the level of the top of the spa and thus the highest possible level of P.

Water flowing from spa P into leg Z of the trap will fill leg Z up to level C. It will not rise higher in leg Z but will spill over into leg Y to fill the connection between legs X and Y. When the water in that connection rises to the level A, a column of air will be trapped in leg Y and its connection to leg Z. The air column will be compressed in some degree by the pressure of the water's weight but the degree of compression is not very great because the head is only the distance between level D and level A less the degree of compression. Compression of the air column permits the rise of water to some level E in legs Y and X. Since level E is substantially lower than level B, the trap is effective to protect the blower from the intrusion of spa water.

The length of the first leg is not critical except that it must extend to some point below the lowest point of the connection between the first and second legs Z and Y. The third leg X must be sufficiently long so that the vertical distance between level E and level B exceeds the vertical distance between level C and level D. It should be noted that the trap tube may have other configurations. Suppose that instead of being bent to the left to form the connection between legs X and Y, the tube was bent to the right to form an oval. It would work as well. Horizontal components of leg dimensions have no effect on operation. Thus, for example, the trap could be formed as a circular loop less than a complete circle as long as the spa end was lower than the top of the loop and the blower end terminated above the low portion of the loop a distance greater than the height of the water above the top of the loop. The point is that the trap shape may be altered to something more convenient provided the height rules are observed. It is also important that no valve is needed as part of the trap or as part of the blower and no moisture protection is required for the electrical circuitry associated with the blower.

One of the problems that faces the spa designer is control of water flow from the spa in the water circulation system. The generation of adequate turbulence requires that recirculating flow rates be relatively high and in practice that means relatively high suction pressure at the circulating pump inlet. High suction pressure at an outlet in the spa wall can be dangerous to children and adults alike. That problem is usually solved by the employment of a weir in the spa wall. Water flowing over the weir enters a sump in which the outlet to the return line is located. The weir is designed such that the pressure drop across it is relatively low and the spa user is isolated from the high suction outlet. But weir design for a spa is complicated by the random and rapid change in water level occasioned by the purposely induced turbulence and by entry and exit and other movement of occupants. Those transient changes are superimposed on different fill levels. Fixed level designs can diminish the degree and form of water turbulence. In the invention a floating gate design is employed which responds to the difference in spa side and sump side water levels. The gate is constrained to move up and down in vertical guides. Its density is close to that of water but is less so that it will float. If the level of water on the sump side equals the level on the spa side of the gate, it rises to substantially stop flow to the sump but if the level on the sump side is lowered so more of the gate is above the sump water level, the gate will sink toward the sump level. That lowering of the gate permits increased flow over the weir. The gate tends to rise through the overflow and it also tends to rise as a consequence of increased level on the sump side. Friction between the gate and its guides and inertial forces prevent the gate from responding to very short term water level changes. The result is a weir operation which is self adjusting to all but short term level change and which has no adverse effect on water turbulence generation.

Figure 6:
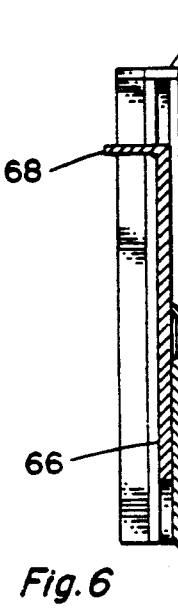
FIG. 6 is a cross-sectional view taken on line 6—6 of FIG. 5.
Figure 5:
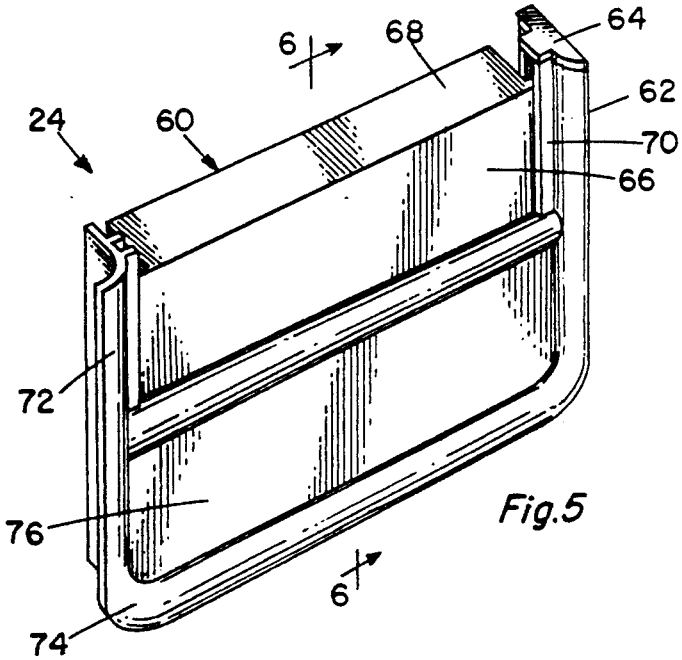
FIG. 5 is an isometric view of the weir of the invention.

The currently preferred form of weir is shown in FIGS. 5 and 6. It includes four parts. There is a floating gate 60, a gate retaining frame 62 and two frame guide covers only one 64 of which is shown. The other of the covers is the mirror image of the one shown. It was omitted so that the top of the guide and guide configuration may be seen. The floating gate in this model includes a flat rectangular, main plate 66 having a narrow rectangular plate 68 extending as a lip, in a plane normal to that of plate 66, from the upper edge of plate 66 toward the sump side of the float. Other models, not shown, are formed of thinner material and are provided with ribs on the sump side to add strength. The several forms, like the gate shown, are assembled with the retaining frame such that the side edges of the main plate are disposed for vertical reciprocation in the spaced guides or channels which form part of the retaining frame. The guides, 70 at the right and 72 at the left in FIG. 5, are integrally formed with a U-shaped escutcheon member 74. The escutcheon fits into complementally shaped conformations in the shell wall at the spa side of the sump cavity such that water is substantially prevented from passing from the interior of the spa to the sump between the escutcheon and the shell wall. A lower, fixed gate section 76 forms a panel extending across the lower half of the escutcheon. In this model it is integrally formed with, and lies in the plane of the lower portion of the sides of the guide channels 72 and 74. In other models the panel 76 is offset from the plane of the channel and is formed with ribs which extend to the plane of the channel. The object is to limit the amount of water that can leak between the panel and plate 66 of the floating gate while permitting the floating gate unhindered freedom to move up and down in response to water level change.

In obedience to the rules, the best mode now known for practicing the invention has been shown in the accompanying drawing and described in the specification above. However, it is to be understood that other embodiments and variations of the invention are possible and that the invention is to be limited by what is defined in the appended claims rather than by what has been shown.

I claim:

1. A spa comprising:

a molded shell of the type in which spa water is disposed in an interior of the shell, the shell formed with a plurality of air outlet openings which extend through the shell at points below a surface of the water, and an air blower having a blower outlet and a flow path for air, said flow path extending from said blower outlet to each of said air outlet openings of the shell, said flow path comprising:

a manifold pipe positioned generally horizontally below portions of said shell, the manifold pipe being formed with a plurality of air outlet ports;

a backflow prevention mechanism positioned in said flow path between said manifold pipe and said blower outlet for preventing backflow of water from said manifold pipe to said air blower; and a plurality of flow tubes each connected between a respectively associated one of said air outlet openings and a respectively associated one of said ports, wherein said shell includes an integrally molded sump cavity, an entry opening affording access to the sump cavity for water from the interior of the spa, and a weir disposed in said entry opening, said weir comprising:

a pair of spaced guides of a given length arranged for vertical disposition on opposite sides of said entry opening;

a lower gate having height less than the given length of said guides, said lower gate being fixed to said guides and having a width spanning a distance between lower portions of said guides in a generally vertical plane when the guides are vertically disposed; and a floating gate comprising a plate having its side edges disposed in respectively associated ones of said guides for reciprocation relative to the guides in a plane parallel with said lower gate, the floating gate having density nearly that of water.

2. A spa unit comprising a molded spa shell which includes an integrally molded sump cavity, an entry opening affording access to the sump cavity from an interior of the spa shell, and a weir, said weir comprising:

a pair of spaced, juxtaposed guides of a given length arranged for vertical disposition in said entry opening;

a lower gate having a height less than the given length of said guides, said lower gate being fixed to said guides and having a width spanning a distance between lower portions of said guides in a generally vertical plane when the guides are vertically disposed; and a floating gate comprising a plate having side edges disposed in respectively associated ones of said guides for reciprocation relative to the guides in a plane parallel with said lower gate, the floating gate having density nearly that of water.

3. The spa unit defined in claim 2 in which said weir comprises a lateral extension at its side toward said sump cavity.

4. A spa unit according to claim 2 wherein said weir includes a U-shaped frame member having a bottom portion and two upwardly extending leg portions, the frame member mounted in the entry opening, wherein the guides are disposed in the leg portions of the frame member and wherein the lower gate is mounted to the frame member.

5. A spa unit according to claim 2 wherein the lower gate is integrally formed with the guides.

6. A spa comprising:

a molded spa shell adapted to contain water;

a sump cavity integrally molded within a side wall of said spa shell;

an entry opening affording access for water to the sump cavity from an interior of the spa shell; and a weir disposed in said entry opening, said weir comprising:

a pair of spaced, juxtaposed guides within said entry opening;

a fixed lower gate portion adapted to be positioned below a surface of the water in a generally vertical plane, said fixed lower gate portion spanning a distance between lower portions of said guides; and a floating gate portion comprising a plate having its side edges disposed in respectively associated ones of said guides for reciprocation relative to the guides in a plane parallel with said fixed lower gate portion.

7. A spa according to claim 6 wherein said weir includes a U-shaped frame member having a bottom portion and two upwardly extending leg portions, the frame member mounted in the entry opening, wherein the guides are disposed in the leg portions of the frame member and wherein the fixed lower gate portion is also mounted to the frame member.

8. A spa according to claim 6 wherein the fixed lower gate portion is integrally formed with the guides.

9. A spa according to claim 6 wherein the fixed lower gate portion is offset from the plane of the plate.

10. A spa according to claim 6 wherein the floating gate portion has a density less than that of water.

11. A spa according to claim 6 wherein the guides are formed separately from sides of the entry opening.

12. A spa according to claim 6 wherein the fixed lower gate portion is formed separately from sides of the entry opening.

13. A spa according to claim 6 further comprising a lid covering the sump cavity.

14. A spa comprising:

a molded spa shell having side walls and formed to contain water in an interior thereof;

a molded sump cavity positioned on a side wall of said spa shell;

an entry opening affording access to the sump cavity for water contained in the interior of the spa shell; and a weir disposed in said entry opening, said weir comprising:

a guide mechanism positioned in said entry opening;

a fixed lower gate portion positioned below a surface of the water in a generally vertical plane, said fixed lower gate portion spanning a distance between the opposite sides of said entry opening; and a floating gate portion comprising a plate having side portions disposed in said guide mechanism for reciprocation relative to said guide mechanism in a plane generally parallel with said fixed lower gate portion.

15. A spa according to claim 14 wherein the guide mechanism comprises a U-shaped frame member having a bottom portion and two upwardly extending leg portions with the U-shaped frame member being mounted in the entry opening, wherein the side portions of the plate are disposed in the leg portions of the frame member and wherein the fixed lower gate is also mounted to the U-shaped frame member.

16. A spa according to claim 14 wherein the fixed lower gate portion is offset from the plane of the plate.

17. A spa according to claim 14 wherein the floating gate portion has a density less than that of water.

18. A spa according to claim 14 further comprising a lid covering the sump cavity.

19. A spa according to claim 14 wherein the fixed lower gate portion is formed separately from sides of the entry opening.

20. A spa according to claim 14 wherein the fixed lower gate portion comprises a separate plate piece mounted in the entry opening.

* * * * *